US005671758A

United States Patent [19]

Rongved

[11] Patent Number: 5,671,758

[45] Date of Patent: Sep. 30, 1997

[54] CATALYTIC CIGARETTE SMOKE CLEANING DEVISE AND PROCESS

[76] Inventor: Paul I. Rongved, 5701 Blvd. East Apt. 12 H, West NY, N.J. 07093

[21] Appl. No.: 355,002

[22] Filed: Dec. 13, 1994

[51] Int. Cl.[6] ..... A24B 15/18

[52] U.S. Cl. ..... 131/334; 131/331

[58] Field of Search ..... 131/331, 334

[56] References Cited

U.S. PATENT DOCUMENTS 4,450,245 5/1984 Adair et al. ..... 502/211

*Primary Examiner*—James J. Seidleck
*Assistant Examiner*—Duc Truong

[57] ABSTRACT tobacco filled smoking article adopted to produce less toxic substances such as carbon monoxide in the combustion gases, adding solid inert, stable non polluting catalysts in or near the tobacco, causing substantial catalytic reduction of carbon monoxide in the combustion gases.

1 Claim, 3 Drawing Sheets

CATALYTIC CIGARETTE SMOKE CLEANING DEVISE AND PROCESS

BACKGROUND OF THE INVENTION

The instant invention relates generally to a process or method to reduce or eliminate harmful gases in cigarettes, pipes or cigar smoke before it is inhaled by humans. Presently, there are many types of filters in use, attached as part of a cigarette or loose to be attached to the cigarettes when smoked. Such filters remove some of the tar, nicotine, and particulates in the smoke, but not the harmful gases.

When a smoker inhales from a lit cigarette, fresh air is inhaled which supports the combustion of the tobacco and carbon dioxide ($CO_2$) and ash is formed at the tip. The combustion continues when the smoker is not inhaling, but then with oxygen starved air and the carbon, carbon monoxide (CO) is formed and is pulled in when the smoker again inhales. Not much CO is inhaled, or it would kill the smoker. But CO is a very dangerous and poisonous gas and it is, during years of smoking, a most detrimental part of smoking. Carbon monoxide (CO) has a 200 times greater attraction of hemoglobin, the red blood cells, than oxygen ($O_2$). The CO remains connected to the blood cell for the rest of its life. It prevents the red blood cell from carrying any oxygen to the body cells which is its normal, main function. All cells and parts of the human body is, therefore, being robbed of needed oxygen. This weakens all parts and functions of the body and with years of smoking, will contribute to numerous sicknesses and death.

The reduction of CO in cigarette smoke is, therefore, of utmost importance. Furthermore, CO is an odorless, tasteless and colorless gas; its reduction or elimination will not reduce the aroma and enjoyment of smoking.

The present invention of reducing or eliminating carbon monoxide in cigarette smoke is based on the last eight (8) years advancement in surface chemistry and new tools for viewing action, on molecular level, of gases and solids.

It is therefore, an important object of this invention to make it economically feasible to produce cigarettes which have substantial less carbon monoxide in the inhaled smoke.

SUMMARY OF THE INVENTION

An object of the invention is that of providing tobacco-filled smoking articles, in particular cigarettes, cigars and tobacco for pipes which contain a reduced proportion of carbon monoxide in the combustion gases and smoke without impairing the flavor of the inhaled smoke. This object, is achieved in accordance with the present invention by applying inert, stable and non poisonous metallic catalysts such as Vanadium Pentoxide, Molybdenum trioxide or Rhodium oxides during the manufacturing process to the tobacco itself, blend the catalysts into its ingredients or apply it to the inside of the cigarette paper or to the filter of the smoking articles. Such metal catalysts being very small and well distributed, having large surfaces to weight ratios will attach in spots to cracks and crevices in the tobacco or activated carbon or other filter material or alternatively be exposed as tobacco ingredients burn away so all free surfaces can act as catalysts. the tiny catalysts will heat up instantly from the combustion gases and removed carbon monoxide with the catalytic reactions on the many tiny catalyst surfaces without any reaction, change or consumption of the catalysts themselves. The gas molecules and atoms being so infinitesimal small that there is room for many thousands of them on the tiny catalyst surfaces.

The toxic CO is transformed into harmless $CO_2$.

Figure 1A:
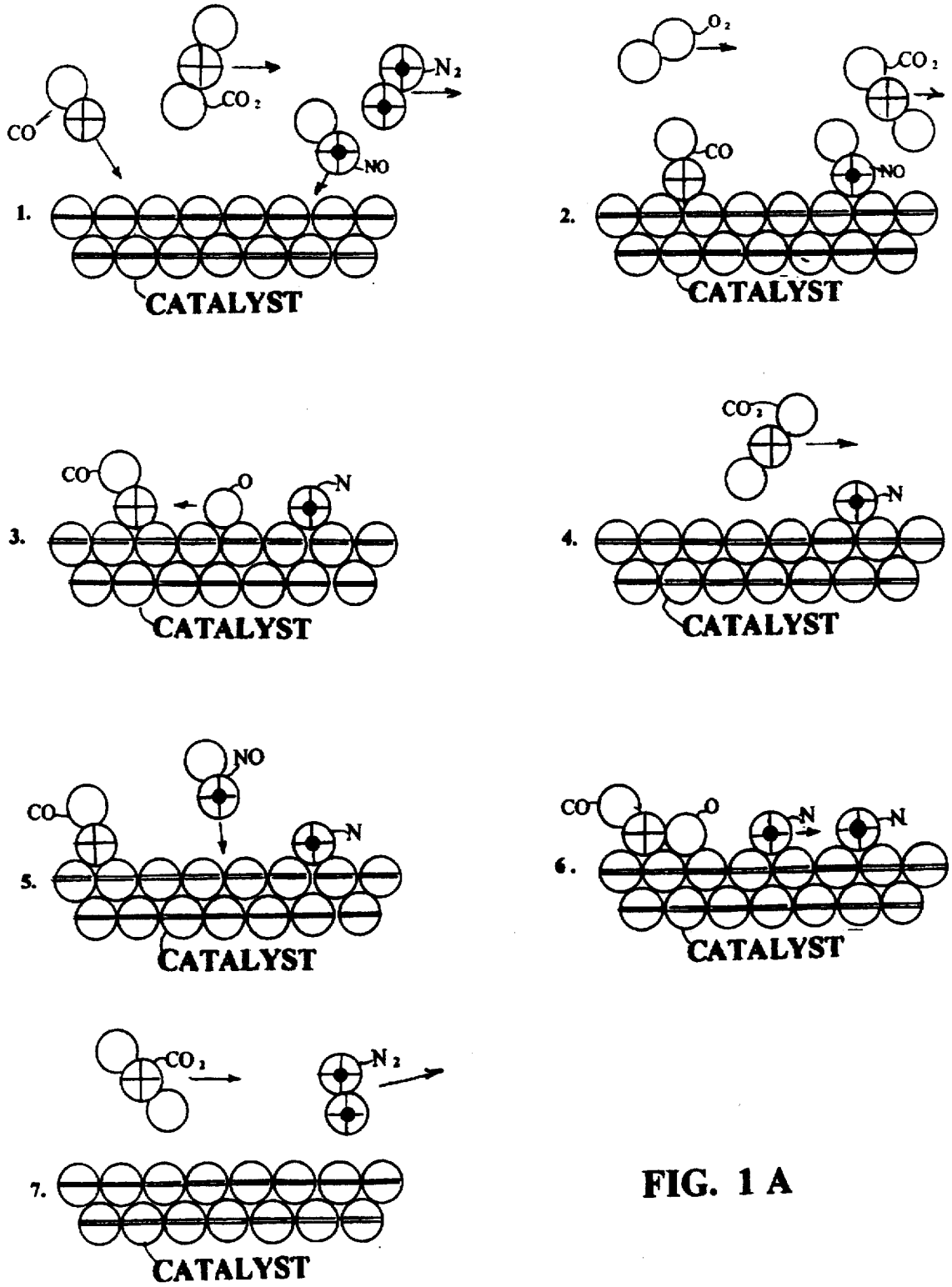
FIGS. 1A, 1B AND 1C are not to scale, schematics, based on scientific and technological breakthrough in the last decade, showing individual gas molecule's and atom's interactions on the surface of a solid catalyst. Some gas molecules such as $CO_2$, $O_2$ and $C_2$ are not attracted to the surface, other gases are attracted such as CO, NO and $O_3$ and atoms O, N and C.

FIG. 1A shows 7 steps, one CO and one NO land on the surface NO breaks down to the individual atoms N and O; O is attracted and move on the surface to CO forming $CO_2$ which moves away, later two N atoms form $N_2$ which moves away, leaving the surface free.

Figure 1B:
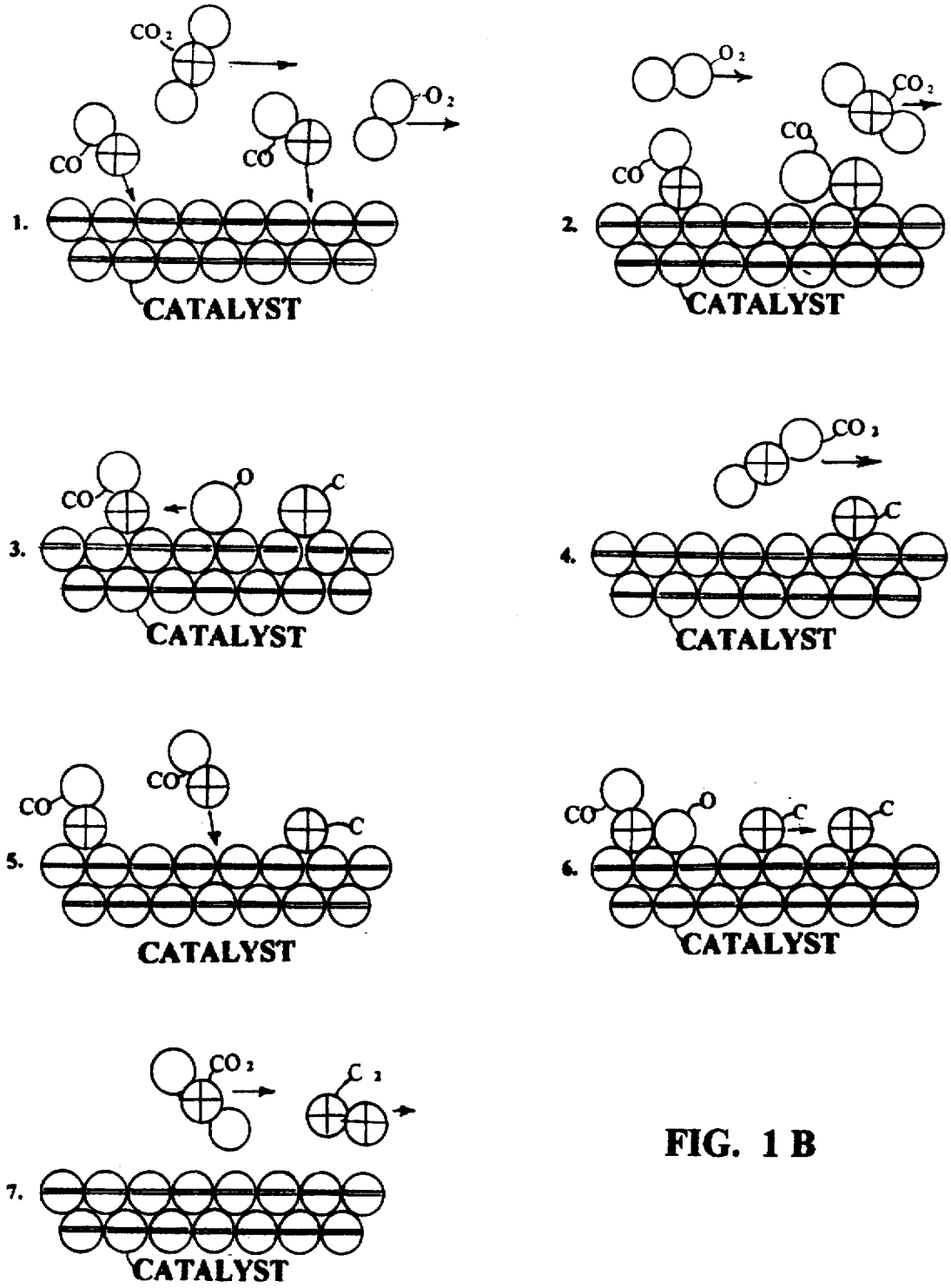

FIG. 1B shows 7 steps, two CO lands on the surface one break down to atoms C and O, O and CO form $CO_2$ which moves away , later two C atoms form $C_2$ which moves away leaving the surface free.

Figure 1C:
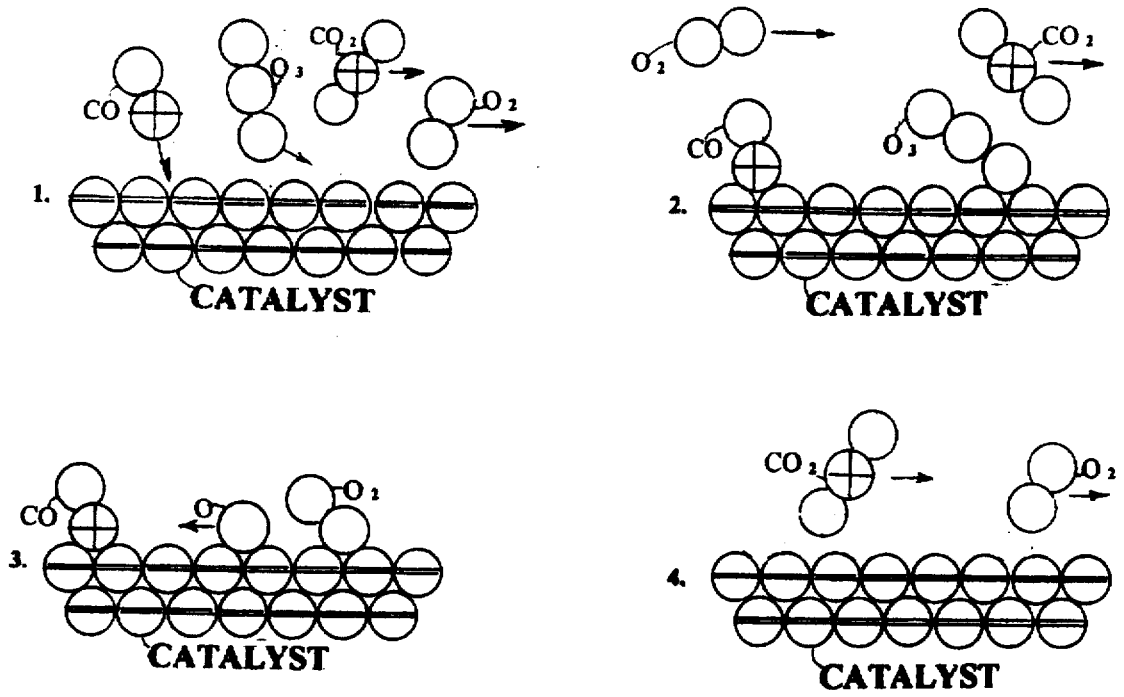

FIG. 1C shows 4 steps, one CO and one $O_3$ land and $O_3$ breaks up to $O_2$ which moves away and atom O moves to CO forming $CO_2$ which moves away leaving the surface free.

It should be noted that on the tiny surfaces of the catalysts described in the present invention, thousands of the infinitesimal small gas molecules and atoms will have place, this is not indicated above.

DETAILED DESCRIPTION OF INVENTION

Some gases such as carbon monoxide (CO) and nitric oxide (NO) are attracted to the surface of certain metalicoxide catalysts, where the catalytic processes take place, without any reaction or change of the catalyst itself.

When these gas molecules are seated on such as surface, the internal bond in the gases loosen and some break up and the N, C and O atoms are separately attached to the metal. These atoms are attracted to other gas atoms and gas molecules. In this way, $CO+O=CO_2$ is formed on the surface which then will lose its attraction to the metal and it moves on. $N+N=N_2$ and $C+C=C_2$ is also formed and moves away, leaving the surface of the metal free for more processing. According to the present invention, a fine powder of catalysts, the size of the grains in table salt or smaller, will be applied during the manufacturing process, with heat or force, to the tobacco itself, the inside of the cigarette paper or filter media or be blended with ingredients which are added to increase aroma and quality of the tobacco. The tiny catalysts get stuck in the tobacco or the filter. When a cigarette is lit, the tobacco, ingredients and cigarette paper burn at high temperatures, producing combustion gases and instantly heating the tiny catalysts and freeing many of its surfaces, each with room for thousands of the infinitesimal small gas molecules and atoms. When the cigarette smoke is inhaled through the tobacco and the filter, the flow will be very turbulent. Carbon monoxide and nitric oxide in the smoke will hit and get attached to any of the free sides of the catalytic particles and be reduced to harmless gas before it is inhaled. SEE CATALYTIC PROCESS STEPS TYPE A, B AND C ON FIG. 1A, FIG. 1B AND FIG. 1C.

What is claimed is:

1. A tobacco filled smoking article, comprising cigarettes, cigars or tobacco filled pipes, being adapted to catalytically remove carbon monoxide (CO) from gaseous products of combustion, comprising distributed, in or near combusting material tiny pieces of stable and non poisonous, solid metal oxide catalysts, which instantly will be heated by combustion and the combustion gases and will transform catalytically molecules of carbon monoxide, on its free tiny surfaces, to harmless carbon dioxide, and in the process will not be changing or consuming itself, but will remain in the ash, stuck in the rest of the unburned parts or filters.

* * * * *